United States Patent [19]

Beaulieu

[11] Patent Number: 4,658,560

[45] Date of Patent: Apr. 21, 1987

[54] SUPPORT AND ATTACHMENT BRACE

[76] Inventor: Bryan J. Beaulieu, 1205 - 132nd St. West, Burnsville, Minn. 55337

[21] Appl. No.: 792,318

[22] Filed: Oct. 28, 1985

[51] Int. Cl.[4] ..... E04H 12/18; G04F 15/00

[52] U.S. Cl. ..... 52/646; 52/109; 248/166; 211/182; 40/610

[58] Field of Search ..... 52/645, 646, 109, 81, 52/36; 40/610; 248/166, 165; 211/182, 183

[56] References Cited

U.S. PATENT DOCUMENTS

| | | | |
|---|---|---|---|
| 1,161,934 | 11/1915 | Gilmore | 211/182 |
| 3,121,977 | 2/1964 | Bersudsky | 52/DIG. 4 |
| 3,561,518 | 2/1971 | Johnson | 52/63 |
| 4,241,746 | 12/1980 | Rothe | 52/645 |
| 4,276,726 | 7/1981 | Derus | 52/109 |
| 4,317,523 | 3/1982 | Konstant et al. | 108/107 |
| 4,471,548 | 9/1984 | Goudie | 52/109 |
| 4,500,146 | 2/1985 | Peterson | 108/107 |
| 4,512,097 | 4/1985 | Zeigler | 40/610 |

*Primary Examiner*—William F. Pate, III
*Assistant Examiner*—Caroline D. Dennison
*Attorney, Agent, or Firm*—Paul L. Sjoquist

[57] ABSTRACT

A support and attachment brace for a collapsible display panel structure having hub assemblies with outwardly facing fastening buttons thereon, including an elongated rigid bar or brace with top and bottom ends each being adapted for releasably interconnecting with one of a pair of confronting vertically aligned fastening buttons. A magnetic strip along the length of the brace provides a means for releasably attaching a sheet of material to the brace to cover the panel structure or display a graphic representation. A plurality of vertically aligned slots in the brace are adapted for releasably attaching shelving or other panel structure accessories to the structure.

16 Claims, 14 Drawing Figures

SUPPORT AND ATTACHMENT BRACE

BACKGROUND OF THE INVENTION

This invention relates to collapsible, self-supporting structures, and more particularly to a support and attachment brace which is releasably attachable to a collapsible, self-supporting display panel structure.

Collapsible self-supporting structures have a network of support rods which are pivotally joined together by hub assemblies (as disclosed in my copending application Ser. No. 792,130, filed Oct. 28, 1985 now U.S. Pat. No. 4,627,210) for movement between a collapsed, compact position for storage or transportation and an open or erect condition in which the desired structural shape is attained. Dome or arch-shape structures of this type may be illustrated by U.S. Pat. Nos. 3,838,703; 3,968,808; 4,026,313; and 4,290,244.

Collapsible display panel or wall structures of the type having planar or arcuate face surfaces may be illustrated by U.S. Pat. Nos. 4,276,726 and 4,471,548. Such panel structures are commercially available and are useful for trade shows and the like.

The collapsible display panel structures are typically covered by a sheet of material adapted for either covering the front of the panel structure or displaying a graphic representation. The portable structures may then be used to form the backdrop of a trade show booth. Aforementioned U.S. Pat. No. 4,471,548 teaches a means of attaching the sheet to the structure by cooperating Velcro and magnetic strips along with corresponding hole and male fastener arrangements.

The panel structures do have some drawbacks, however; they are generally light in weight and lack in vertical supportive strength, and they frequently are incapable of supporting more than a sheet of material, such as display accessories that are customarily used at trade shows. Furthermore, there is generally no place on the covered structures to mount or attach the display accessories.

SUMMARY OF THE INVENTION

A support and attachment brace for a collapsible display panel structure having hub assemblies with outwardly facing fastening buttons thereon comprises an elongated rigid bar or brace with top and bottom ends. The top end has a tab with an opening adapted for releasably interlocking with one of a pair of confronting adjacent vertically aligned fastening buttons in a nesting arrangement. The bottom end has an ear with an aperture adapted for releasably interlocking with the other aligned fastening button in a similar nesting arrangement. The tab, ear and fastening buttons are adapted to permit several of the braces to be interconnected to the structure in a vertical column arrangement. The tab and ear each have cooperative flat horizontal surfaces for immobilizing contact or engagement to convey rigidity to the column.

A magnetic strip afixed along the length of the brace provides a means for releasably attaching a sheet of material to the brace to cover the panel structure with a display or graphic representation. A plurality of vertically aligned slots in the brace are adapted for releasably attaching shelving or other display accessories to the panel structure.

The present invention advantageously provides vertical supportive strength and rigidity to collapsible display panel structures and futher permits attachment of various display accessories, such as sheets of material, shelving, etc. The braces quickly and easily interconnect with vertically aligned hub assemblies and require no special adaptations of the support rods or the panel structure.

DESCRIPTION OF THE PREFERRED EMBODIMENT

Figure 1:
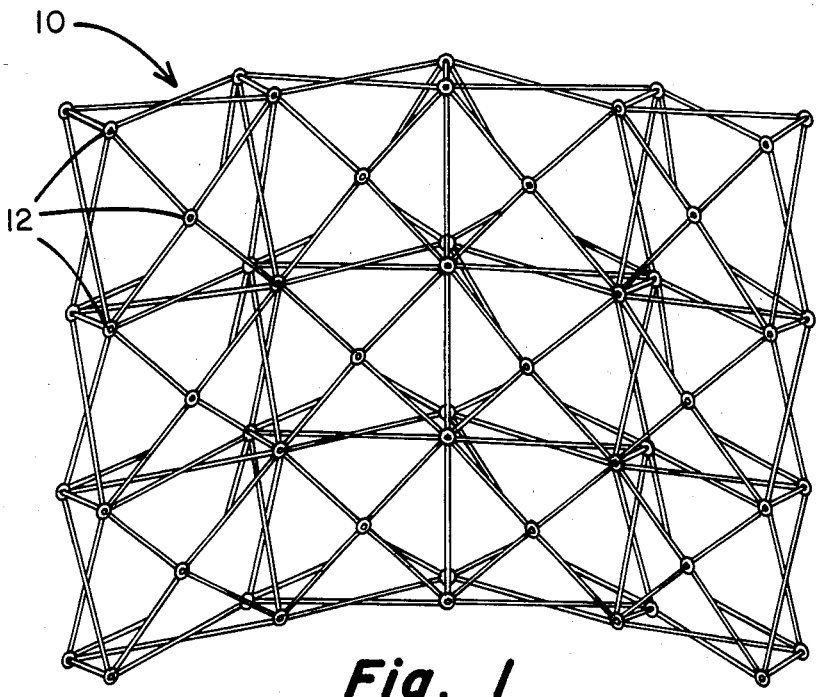
FIG. 1 is a front elevational view of a collapsible display panel structure.
Figure 2:
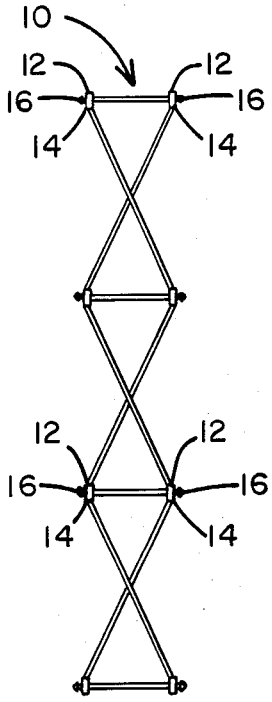
FIG. 2 is a side elevational view of the end support rods and hub assemblies.
Figure 3:
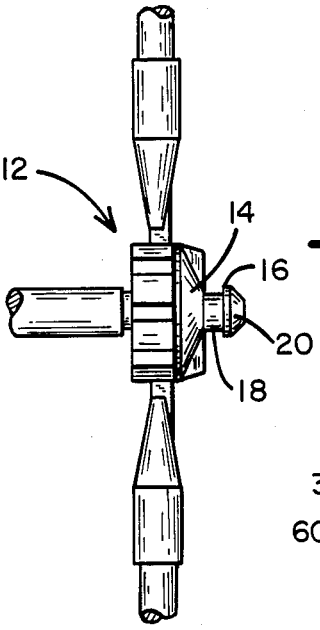
FIG. 3 is a side elevational view of a hub assembly having a fastening button thereon.

Referring to FIGS. 1 through 3, collapsible display panel structure 10 has hub assemblies 12 pivotally holding the support rod ends of the skeletal frame of structure 10. Hub assemblies 12 suitably each have an outer face 14 with a centrally located and outwardly facing fastening button 16 thereon. Button 16 includes stub shaft or shank 18 and enlarged head 20.

Figure 4:
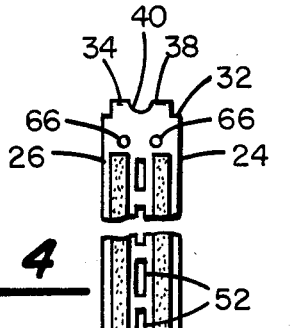
FIG. 4 is a front elevational view of a support and attachment brace.
Figure 5:
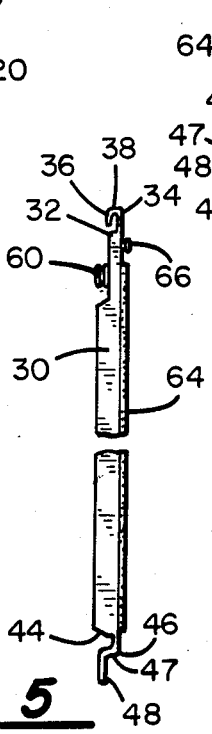
FIG. 5 is a side elevational view of the brace.
Figure 6:
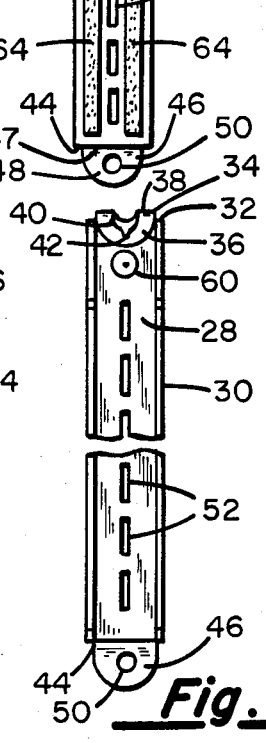
FIG. 6 is a rear elevational view of the brace.

As shown in FIGS. 4 through 6, support and attachment brace 24 has a front face 26, back 28 and stiffening sides 30. Top interlocking end 32 appropriately has a tab 34 extending therefrom. Tab 34 has a backwardly turned over portion 36 forming a substantially flat horizontal shoulder 38. Tab 34 has an opening 40 appropriately extending into the turned over portion 36 with a semicircular notch 42 near its bottom periphery.

Bottom interlocking end 44 appropriately has a backwardly and downwardly extending ear 46 forming a substantially flat horizontal portion or surface 47 and a downward portion or extension 48. Extension 48 has an aperture 50.

Opening 40 and aperture 50 of brace 24 are substantially equal in diameter or width. Their diameters are slightly larger than the diameter of head 20. Notch 42 appropriately has a diameter substantially equal to the diameter of shank 18. Opening 40 and aperture 50 are suitably spaced apart slightly more than any two vertically aligned fastening buttons 16. When brace 24 is connected to structure 10, the distance between aligned hub assemblies 12 having buttons 16 is slightly expanded. The rigid nature and supportive strength of brace 24 is thereby directly conveyed to structure 10.

A plurality of vertically oriented slots 52 medianly extend the length of support brace 24. Circular fastener 60 is suitably affixed to the back 28 of support brace 24 and has an outer circumferential channel or groove 62. Magnetic strips 64 are appropriately affixed to the front face 26 of support brace 24 adjacent slots 52. Pins 66 are located near the top interlocking end 32.

Figure 8:
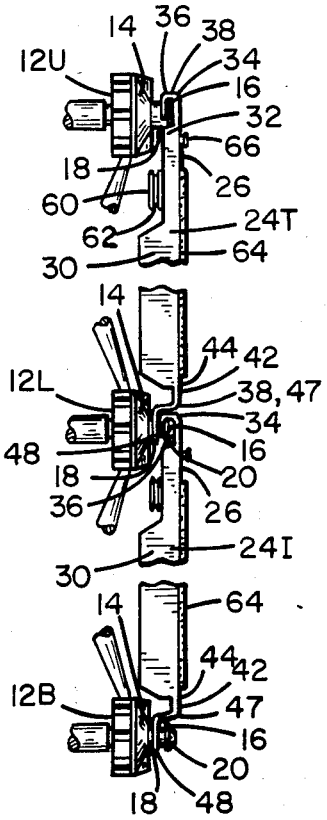
FIG. 8 is a side elevational view of two braces, partially broken away, interconnected to the fastening buttons of the hub assemblies.
Figure 7:
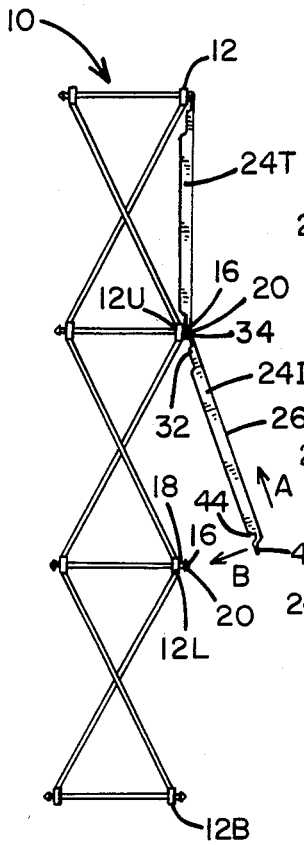
FIG. 7 is a side view of the brace being attached to the end hub assemblies of FIG. 2.
Figure 9:
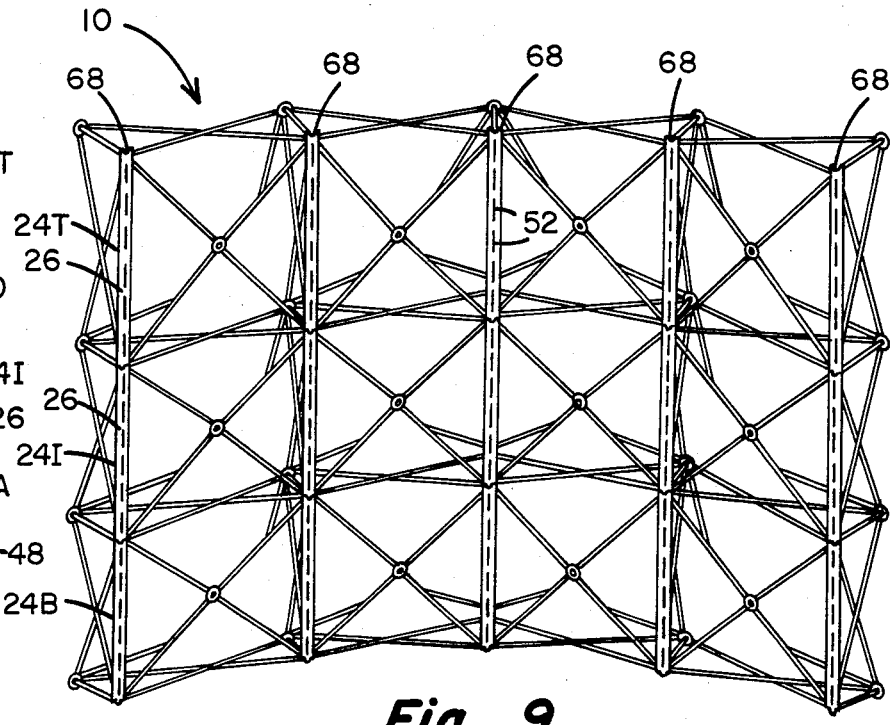
FIG. 9 is a front elevational view of the collapsible display panel structure having vertical columns of braces connected thereto.
Figure 11:
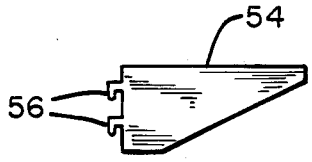
FIG. 11 is a side elevational view of a shelving support bracket.
Figure 10:
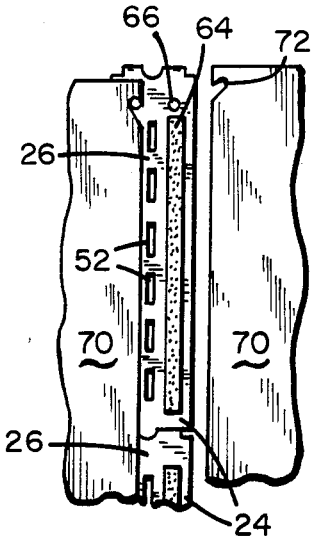
FIG. 10 is a front elevational view partially broken away of sheeting material attachable to the support and attachment brace.

Referring to FIGS. 7 through 9, the attachment operation and interconnecting arrangement of multiple support braces 24 and vertically aligned hub assemblies 12 may be seen. Detail of individual components may be seen in FIGS. 3 through 6 as previously discussed. Because all braces 24 and hub assemblies 12 are the same in construction and method of attachment, top brace 24 is shown already connected to structure 10 (FIG. 7) to illustrate its interconnecting operation and cooperative arrangement with bottom brace 24. The attachment operation begins at upper hub assembly 12U and finishes at bottom vertically aligned hub assembly 12B forming a vertical column 68 comprised of interconnected top 24T, intermediate 24I and bottom 24B braces (FIG. 9).

Initially, opening 40 in tab 34 of intermediate brace 24I is guided over head 20 of fastening button 16 of upper aligned hub assemblies 12U. An upward force (arrow A) is then used to bring shoulder 38 of intermediate brace 24I into flush engagement with flat surface 46 of top brace 24T. By this action, notch 42 of brace 24I is also brought into engagement with shank 18 of upper hub assembly 12U. Ear 46 of brace 24I is then swung inwardly (arrow B) while still exerting upward force (arrow A) as aperture 50 is guided over head 20 of lower hub assembly 12L. Intermediate brace 24I is then attached. This operation is repeated for brace 24B (FIG. 9) and all other braces 24 to be connected to structure 10. Front faces 26 of all interconnected adjacent support braces 24 are also coplanar by this unique arrangement.

While notch 42 in tab 34 engages shank 18 preventing head 20 from passing out of opening 40, tab 34 also secures or interlocks ear 46 of top brace 24T to upper hub assembly 12U. Flat surface 46 of top brace 24T and shoulder 38 of intermediate brace 24I abut or engage each other thereby immobilizing top and intermediate brace 24T and 24I with respect to each other. This interlocking and nesting arrangement forms rigid vertical column 68.

The combination of vertical braces 24 and truss members 80–85 form a true structural truss which is capable of supporting a substantial weight. All vertical forces are transmitted to the ground through braces 24, while truss members 80–85 provide structural strength and support in the classical sense of a true truss. It is apparent that vertical braces 24 may also be incorporated at the rear side of collapsible panel structure 10, to thereby form a display panel structure capable of supporting weight loads on either the front or the rear surface.

Referring to FIGS. 9 through 12, erected collapsible display panel structure 10 may be seen having support braces 24 interconnected thereto in vertical columns 68 extending the height of structure 10. As mentioned, interconnected braces 24 add rigidity and supportive strength to structure 10. That is, structure 10 is sturdier and now capable of safely bearing the weight of various display accessories that may be attached thereto.

Sheeting material, appropriately fabric 70, may be used to cover or hide structure 10 or to display a graphic representation. Fabric 70 is suitably dimensioned to cover the height of structure 10 and to overlap magnetic strips 64 (FIG. 10) on planar front faces 26 of braces 24 of adjacent vertical columns 68.

Fabric 70 has notches 72 near the top of its side edges. Notches 72 are dimensioned to cooperatively slide over pins 66 t thereby hang fabric 70 thereon. Fabric 70 suitably has magnetic strips 74 attached along its backside edges. These magnetic strips 74 are oriented for reverse magnetic polarity with magnetic strips 64 on braces 24 to thereby cooperatively attract and hold fabric 70 to magnetic strips 64. This arrangement will keep fabric 70 evenly and tautly attached to panel structure 10 in an aesthetically pleasing fashion. End fabric panels 76 may also be connected to the panel structure 10 utilizing the magnetic strips 64 on either end of vertical column 68.

Figure 12:
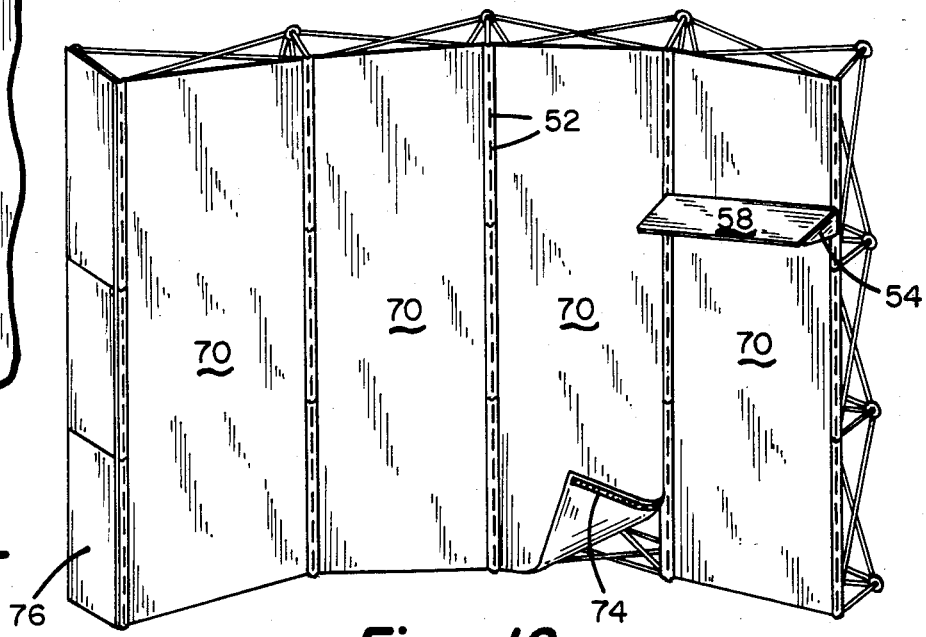
FIG. 12 is a front elevational view of a covered panel structure having support and attachment braces thereon.

Vertical slots 52 provide a means for safely attaching display accessories to a panel structure 10 having support braces 24. For example, shelving brackets 54 (FIG. 11) have locking fingers 56 which will cooperatively interlock with vertical slots 52. Shelf 58 may thereby be attached to panel structure 10 (FIG. 12).

Circular fastener 60 is suitable for attachment of other display accessories such as a modular light which is disclosed more fully in my copending application.

Figure 13:
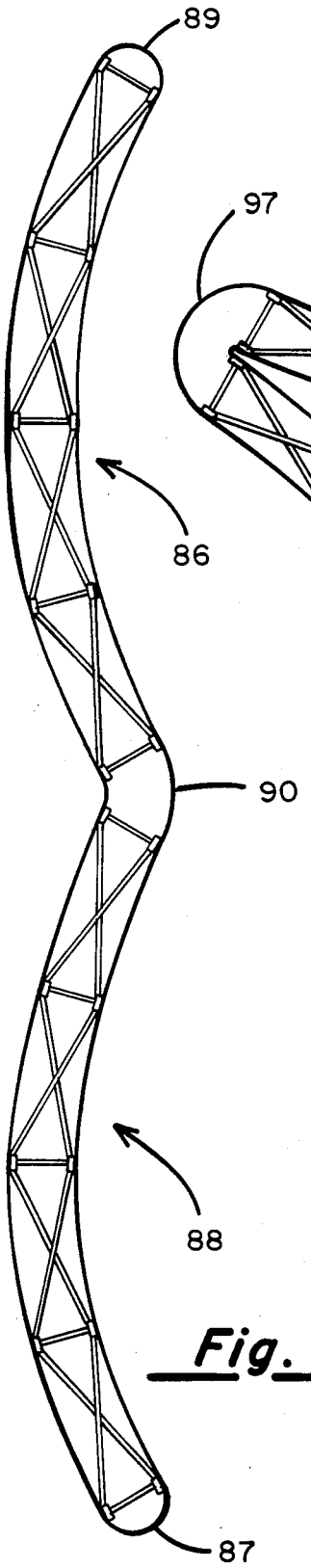
FIG. 13 is a top view of one form of display panel which may be constructed.

FIG. 13 shows a top view of one form of display panel structure which may be constructed using the teaching of the present invention. A first display panel structure is formed into arcuate panel 86, and a second display panel structure is formed into arcuate panel 88. Panels 86 and 88 may have a fabric or other covering on both the front and rear surfaces, utilizing the apparatus described hereinbefore. A curved end section 89 may be formed by utilizing the same material formed into a half circle, and attached to the respective front and rear surfaces by means of the magnetic strips described herein. Likewise, curved section 90 may be similarly formed. When a display panel structure is constructed in this manner, it may form a covered surface which totally encloses the framework described herein, and gives the external appearance of substantial mass, while having an attractive shape. This provides a display structure which may be utilized for display purposes on all sides, and greatly increases the surface area available for display purposes.

Figure 14:
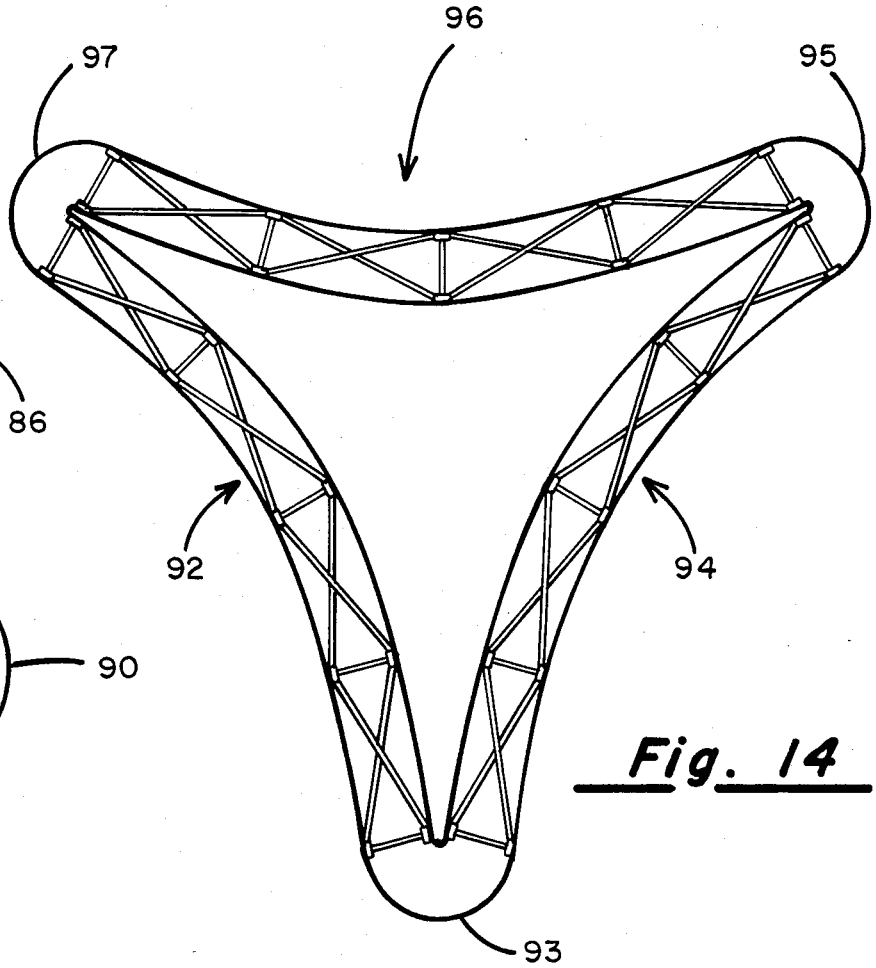
FIG. 14 is a top view of another form of display panel which may be constructed.

FIG. 14 shows another form of display panel structure which may be constructed according to the present invention. In top view, arcuate panels 92, 94 and 96 are arranged in a triangular relationship, having curved sections 93, 95 and 97 formed between their respective ends. A fabric or similar surface may then be applied to the exterior surface areas of the resulting structure, with similar materials used to construct curved ends 93, 95 and 97, to form a totally enclosed display panel structure which may be viewed from all sides. The triangular arrangement of the structure in FIG. 14 provides a relatively large amount of surface area for display purposes, while occupying a relatively small amount of floor space.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A support and attachment brace for vertically supporting a collapsible display panel structure having hub assemblies for pivotally holding support rod ends which form a skeletal frame for the structure, and for supporting a sheet of material adapted for either covering the panel structure or displaying a graphic representation and for attaching display accessories thereto, comprising (a) an elongated rigid bar having top and bottom ends and having a substantially flat elongated surface with a plurality of openings therethrough;

(b) first means for releasably interlocking the ends of the bar to a pair of vertically aligned hub assemblies to add rigidity and supportive strength to the panel structure;

(c) second means for releasably attaching a sheet of material to the substantially flat surface of the bar; and (d) third means for releasably attaching display accessories to the plurality of openings through the surface of the bar.

2. The brace of claim 1 wherein the first means comprises an outwardly facing fastening button on each of the hub assemblies, a tab at the top end of the bar with an opening therethrough and an ear at the bottom end of the bar with an aperture therethrough, the opening and the aperture each being adapted for releasably interlocking with one of the fastening buttons on the aligned hub assemblies.

3. The brace of claim 2 wherein the tab extends from the top end having a backwardly turned over portion forming a substantially flat horizontal shoulder, the opening being in the turned over portion having a notch at the opening's bottom periphery with a width less than the width of the opening; and wherein the ear extends from the bottom end first in a backwardly direction forming a substantially flat horizontal portion and then extends in a downwardly direction, the aperture being in the downwardly extending portion of the ear having a width substantially equal to the width of the opening in the tab.

4. The brace of claim 3 wherein the notch is semicircular.

5. The brace of claim 4 wherein the fastening buttons each include an enlarged head on a shaft extending from the hub assembly, the diameter of the head being slightly less than the width of both the opening and the aperture and the diameter of the shank being substantially equal to the width of the semicircular notch for releasably interlocking the tab and ear of the bar to aligned hub assemblies in a nesting arrangement.

6. The brace of claim 3, in combination with a second like brace wherein the ear and the aperture of the first brace and the tab, opening and notch of the second brace are adapted for interlocking with one fastening button in a nesting arrangement; and wherein the substantially flat horizontal portion of the ear of the first brace and the substantially flat horizontal shoulder of the tab of the second brace are adapted for immobile engagement when the first and second braces are interlocked with three vertically aligned hub assemblies forming a rigid vertical column of braces interlocked to the structure.

7. The brace of claim 1 wherein the second means comprises a first magnetic strip affixed along the length of the bar for attaching and holding a second magnetic strip affixed along the edge of the backside of the sheet, the strips being oriented for opposite magnetic polarity with respect to each other.

8. The brace of claim 1 wherein the third means comprises a plurality of vertically aligned slots in the bar adapted for releasably attaching the display accessories thereto.

9. The brace of claim 6 wherein the display accessories include shelving support brackets for supporting a shelf.

10. The brace of claim 1, further comprising a pin near the top end of the bar for hanging the sheet thereon.

11. A vertically oriented support and attachment brace for attachment to a collapsible structure to add vertical supportive strength to the structure, comprising (a) an elongated rigid bar having top and bottom ends;

(b) a tab extending from the top end having a backwardly turned over portion forming a substantially flat horizontal shoulder, an opening in the turned over portion having a notch at the bottom periphery of the opening, the notch having a width less than the width of the opening; and (c) an ear extending from the bottom end first in a backwardly direction forming a substantially flat horizontal portion and then extending in a downwardly direction and having an aperture in the downwardly extending portion of the ear having a width substantially equal to the width of the opening in the tab.

12. The brace of claim 11, further comprising a plurality of vertically aligned slots in the bar.

13. The brace of claim 11, further comprising a magnetic strip affixed longitudinally along the bar.

14. The brace of claim 11, further comprising a pin affixed adjacent the top end of the bar.

15. A pair of like interlocking support and attachment braces for vertically supporting a collapsible display panel structure having hub assemblies for pivotally holding support rod ends which form a skeletal frame for the structure, and for supporting a sheet of material vertically attached thereon adapted for either covering the panel structure or displaying a graphic representation and for attaching display accessories thereto, comprising (a) first and second elongated rigid bars each having top and bottom ends;

(b) means for releasably interlocking the ends of the first and second bars to three vertically aligned hub assemblies, comprising an outwardly facing fastening button on each of the three hub assemblies, a tab at the top end of each bar with an opening therethrough and an ear at the bottom end of the bar with an aperture therethrough, the opening and the aperture each being adapted for releasably interlocking with one of the fastening buttons on the aligned hub assemblies in a nesting arrangement to connect the bars to the panel structure in a substantially rigid vertical column of braces to add rigidity and supportive strength to the panel structure;

(c) a magnetic strip affixed along the length of the bars for releasably attaching a sheet of material to the bars; and (d) a plurality of vertically aligned slots in the bars adapted for releasably attaching display accessories thereto.

16. The braces of claim 15 wherein they are coplanar.

* * * * *